US010640286B1

(12) United States Patent
Lycourt et al.

(10) Patent No.: US 10,640,286 B1
(45) Date of Patent: May 5, 2020

(54) MULTI-COMPONENT PACKAGE FOR A HEAVY OR BULKY ITEM, SUCH AS AN ARTICLE OF FURNITURE

(71) Applicant: Green Bay Packaging, Inc., Green Bay, WI (US)

(72) Inventors: Lance Lycourt, Holland, OH (US); Anthony Chavatzas, Bucyrus, OH (US)

(73) Assignee: Green Bay Packaging, Inc., Green Bay, WI (US)

( * ) Notice: Subject to any disclaimer, the term of this patent is extended or adjusted under 35 U.S.C. 154(b) by 152 days.

(21) Appl. No.: 15/872,248

(22) Filed: Jan. 16, 2018

Related U.S. Application Data

(60) Provisional application No. 62/446,667, filed on Jan. 16, 2017.

(51) Int. Cl.

| | |
|---|---|
| ***B65D 85/64*** | (2006.01) |
| ***B65B 5/04*** | (2006.01) |
| ***B65B 7/28*** | (2006.01) |
| ***B65D 77/20*** | (2006.01) |
| ***B65B 5/10*** | (2006.01) |

(52) U.S. Cl.
CPC ..... *B65D 85/64* (2013.01); *B65B 5/04* (2013.01); *B65B 5/10* (2013.01); *B65B 7/28* (2013.01); *B65D 77/20* (2013.01); *B65D 2585/648* (2013.01)

(58) Field of Classification Search
CPC .. B65D 2585/648; B65D 85/64; B65D 19/06; B65D 2519/00711; B65B 5/04; B65B 7/28
See application file for complete search history.

(56) References Cited

U.S. PATENT DOCUMENTS

| | | | | | |
|---|---|---|---|---|---|
| 2,633,982 | A * | 4/1953 | Addison | A47C 31/11 | 206/326 |
| 2,797,800 | A * | 7/1957 | Sider | B65D 85/64 | 206/320 |
| 3,504,842 | A * | 4/1970 | Grafslund | B65D 85/64 | 206/320 |
| 3,616,986 | A * | 11/1971 | Wolfe | B65D 85/64 | 206/320 |
| 3,934,720 | A * | 1/1976 | Kratochvil, Jr. | A47C 31/11 | 206/326 |
| 4,098,401 | A | 7/1978 | Brown et al. | | |
| 4,109,876 | A * | 8/1978 | Kratochvil, Jr. | A47C 31/11 | 206/326 |
| 4,185,741 | A * | 1/1980 | Schiff | A47C 31/11 | 206/326 |
| 4,798,294 | A * | 1/1989 | Bodi | B65D 85/68 | 108/55.3 |
| 4,871,061 | A | 10/1989 | Schneider et al. | | |

(Continued)

*Primary Examiner* — Justin M Larson
(74) *Attorney, Agent, or Firm* — Boyle Fredrickson, S.C.

(57) ABSTRACT

A package has a receiving portion having opposing sidewalls extending upwardly from a bottom panel to define an item-receiving area therein, and a cover configured to be positioned about the receiving portion to enclose the item-receiving area. The receiving portion may include reinforcing members extending upwardly from the corners of the bottom panel and positioned at the edges of the sidewalls. A floor member, configured to reduce lateral movement of the item in the item-receiving area, may also be positioned on the bottom panel of the receiving portion.

26 Claims, 15 Drawing Sheets

(56) References Cited

U.S. PATENT DOCUMENTS

| | | | | | |
|---|---|---|---|---|---|
| 5,133,459 | A * | 7/1992 | Genix | B65D 81/107 | 206/305 |
| 5,161,692 | A * | 11/1992 | Knierim | B65D 5/32 | 206/320 |
| 5,301,491 | A | 4/1994 | Boardman, Jr. et al. | | |
| 5,385,293 | A * | 1/1995 | Hirota | B65D 85/64 | 206/320 |
| D431,776 | S * | 10/2000 | Oetken | D3/272 | |
| 6,804,938 | B2 * | 10/2004 | Levin | A47C 31/11 | 53/397 |
| 6,952,907 | B2 | 10/2005 | Levin et al. | | |
| 8,220,627 | B2 * | 7/2012 | DeJesus | B65D 85/64 | 206/326 |
| 9,213,367 | B1 * | 12/2015 | Nelson | G06F 1/1628 | |
| 9,655,307 | B2 * | 5/2017 | Burmann | A01G 9/02 | |
| 10,144,538 | B1 * | 12/2018 | Nash | B65B 29/00 | |
| 2015/0027917 | A1 * | 1/2015 | Goddard | B65D 19/12 | 206/386 |

* cited by examiner

MULTI-COMPONENT PACKAGE FOR A HEAVY OR BULKY ITEM, SUCH AS AN ARTICLE OF FURNITURE

CROSS-REFERENCE TO RELATED APPLICATION

This application claims priority to U.S. Provisional Application No. 62/446,667, filed on Jan. 16, 2017, the entire contents of which are hereby expressly incorporated by reference into this application.

BACKGROUND OF THE INVENTION

1. Field of the Invention

The present invention relates to a package for securing a heavy or bulky movable item, such as an article of furniture, for shipping and transportation.

2. Background of the Invention

Corrugated packaging is routinely used for shipping products to customers. The packaging of movable heavy or bulky items, such as articles of furniture including but not limited to, office chairs, presents a number of challenges. For instance, it is typically desirable to package the item in an upright position for shipment. However, in order to accomplish this, it has in the past been necessary to lift the item over the sidewall of the package and then lower it into the interior of the package. This is a relatively difficult task in that the item may be heavy and/or bulky, and often requires at least two persons to safely accomplish. In addition, the item may be susceptible to side to side movement or shifting within the package during shipping, which may result in damage to the item during shipping and handling.

Therefore, it is an object of the present invention to provide a corrugated package for a heavy and/or bulky movable item, such as an article of furniture, having a construction that makes it easier to position the item within the interior of the package. It is a further object of the invention to provide a package that protects the item from damage that may be caused by side-to-side or shifting movement of the item within the package during shipping and handling.

SUMMARY OF THE INVENTION

The invention is directed to a corrugated package for securing a heavy or bulky movable item, such as an article of furniture, e.g. an office chair, for transportation.

In one aspect, the present invention provides a package including a receiver having a bottom panel and pair of spaced-apart sidewalls extending upwardly from opposite sides defined by the bottom panel. The bottom panel may be adapted to be placed on a supporting surface such as a floor, and an item-receiving area is located above the bottom panel and between the sidewalls. The package may also include a cover configured to be positioned about the receiver for enclosing the item-receiving area and maintaining the item therein.

In another aspect, the invention provides a reinforcing member extending upwardly from each of a series of corners of the bottom panel.

In another aspect, the invention provides reinforcing members that are defined by the sidewalls of the receiver.

In another aspect, the invention provides reinforcing members that are formed by a series of folded panels defined by an extension portion of on the sidewalls.

In yet another aspect, the invention provides a method of packaging an item including the steps of: providing a receiver including a bottom panel and pair of spaced-apart sidewalls extending upwardly from opposite sides defined by the bottom panel, wherein the bottom panel is adapted to be placed on a supporting surface such as a floor and wherein an item-receiving area is located above the bottom panel and between the sidewalls, and wherein an opening is defined by the receiver through which the item-receiving area is accessible; moving the item laterally through the opening into the item-receiving area to position the item within the item-receiving area above the bottom panel; and enclosing the receiver to maintain the item within the item-receiving area defined by the receiver.

In another aspect, the invention provides an additional method step of forming a reinforcing member in each corner of the receiver from a series of folded panels defined by an extension portion of one of the sidewalls.

In another aspect, the invention provides an additional method step of positioning a floor member on the bottom panel, and providing a retainer structure on the floor member that interfaces with the item to prevent lateral movement of the item within the item-receiving area These and other aspects and objects of the present invention will be better appreciated and understood when considered in conjunction with the following description and the accompanying drawings. It should be understood, however, that the following description, while indicating representative embodiments of the present invention, is given by way of illustration and not limitation. Many changes and modifications may be made within the scope of the present invention without departing from the spirit thereof, and the invention includes all such modifications.

BRIEF DESCRIPTION OF THE FIGURES

A clear conception of the advantages and features constituting the present invention will become more readily apparent by referring to the exemplary, and therefore non-limiting, embodiments illustrated in the drawings accompanying and forming a part of this specification, wherein like reference numerals designate the same elements in the several views, and in which.

Figure 1:
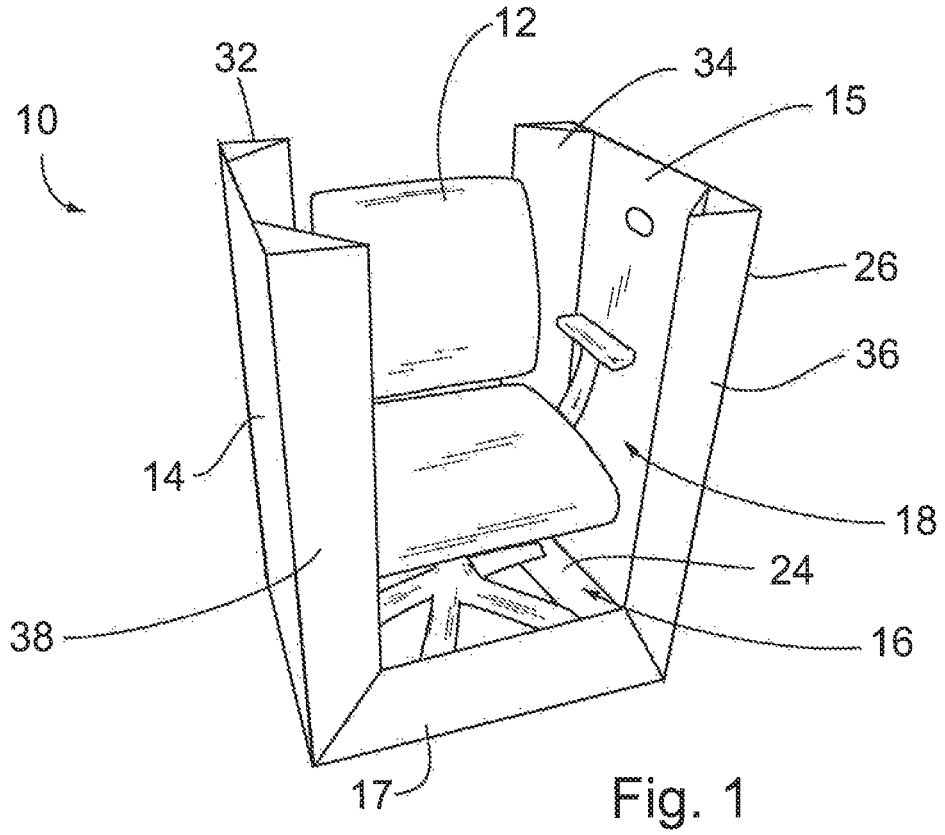
FIG. 1 is a perspective view of a first blank of material folded to form a receiver portion of a package defining an item-receiving area therein, in accordance with one embodiment of the invention, where an exemplary item, e.g. an office chair, is located in the item-receiving area.

In describing the embodiments of the invention, which are illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word "connected," "attached," or terms similar thereto are often used. They are not limited to direct connection, but include connection through other elements where such connection is recognized as being equivalent by those skilled in the art.

DETAILED DESCRIPTION OF THE FIGURES

The present invention and the various features and advantageous details thereof are explained more fully with reference to the non-limiting embodiments described in detail in the following description.

Figure 2:
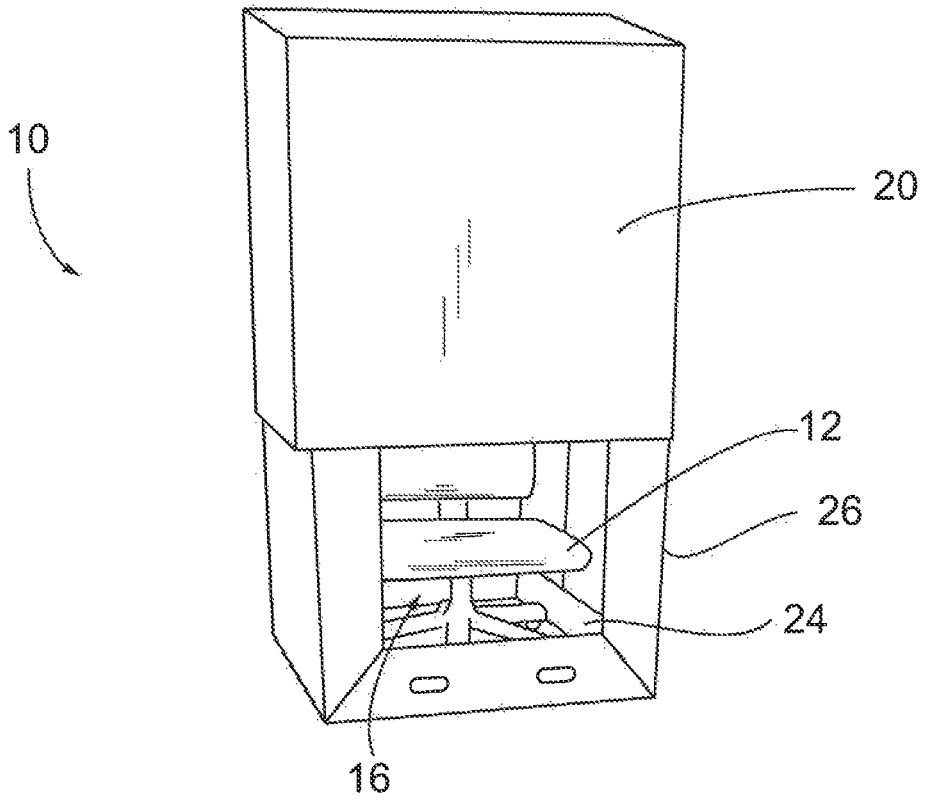
FIG. 2 is a perspective view of the package of FIG. 1 having a second blank of material folded to form a cover portion that has been partially placed over the top of the receiver portion of FIG. 1.

Referring to FIGS. 1 and 2, and initially FIG. 1, a perspective view of a furniture package 10 is shown according to one embodiment of the present invention, with an item 12, e.g., a piece of furniture, located within the package 10. The package 10 is generally made of one or more sheets or blanks of packaging material. The packaging material may consist of corrugated board or any similar material suitable of use in packaging and shipping container constructions. In a manner as is known, the corrugated board consists of a fluted corrugated core located between two sheets of kraft paper or linerboard. In one embodiment, the flutes of the inner core have a longitudinal axis that is parallel to the longitudinal axis of the folded and assembled package 10. The blank or blanks of material may be stamped or cut from a sheet of packaging material while in a substantially flat orientation, and subsequently folded to form the package 10 as will be described in further detail below. The outer surface of the package 10 may be printed to display information such as contents details, shipping information, removal instructions, orientation indicia and the like. The outer surface of the package 10 may also contain advertising information or ornamental elements.

FIG. 1 illustrates the package 10 having: opposing first and second side walls 14, 15; a front wall 17 that extends between the first and second side walls 14, 15 generally at the front of the package 10; and, a rear wall 19 that extends between the first and second side walls 14, 15 generally at the rear of the package 10 and opposite the front wall 17. As shown in FIG. 1, the first side wall 14, second side wall 15, front wall 17 and rear wall 19 collectively define an item-receiving area 16 therein. Generally, the item 12 is placed within the item-receiving area 16, as illustrated. While the representative embodiment illustrates the use of four walls 14, 15, 17, 19, it should be understood that the present invention is not so limited as such and a package 10 that includes more or less than four walls is considered well within the scope of the present invention.

Still referring generally to FIG. 1, at least one of the walls, and in the embodiment illustrated in FIG. 1, front wall 17 and rear wall 19, have a height that is less than that of the side walls 14, 15. That is to say, a void 18 is located above the top edge of the front wall 17 and rear wall 19, and between opposing side walls 14, 15. The void 18 may be utilized as an ingress and egress for the item 12, to facilitate its placement within the item-receiving area 16, by way of passing through the void 18 that is located above at least one of the walls. In this manner, it is not necessary to vertically lift the item 12 above the top edge of the highest wall during loading and unloading of the package 10, which facilitates the easy loading of the item 12 into the item-receiving area 16. Additionally, void 18 allows for the item 12 to be easily viewed when located within the item-receiving area 16. While FIGS. 1 and 2 illustrate the item 12 as a piece of furniture, namely, an office chair, it is contemplated that any item may be packaged within the package 10. As shown in FIG. 2, once the item 12 has been placed through the void 18 and into the item-receiving area 16, a cover 20 may be disposed over and/or around the walls 14, 15, 17, 19 of the package 10 in order to enclose the item-receiving space 16 and protect the item 12 during shipment.

Turning now to FIGS. 3-10, the structure of the furniture package 10 will be described, as the process of forming the furniture package 10 is discussed in further detail.

Figure 3:
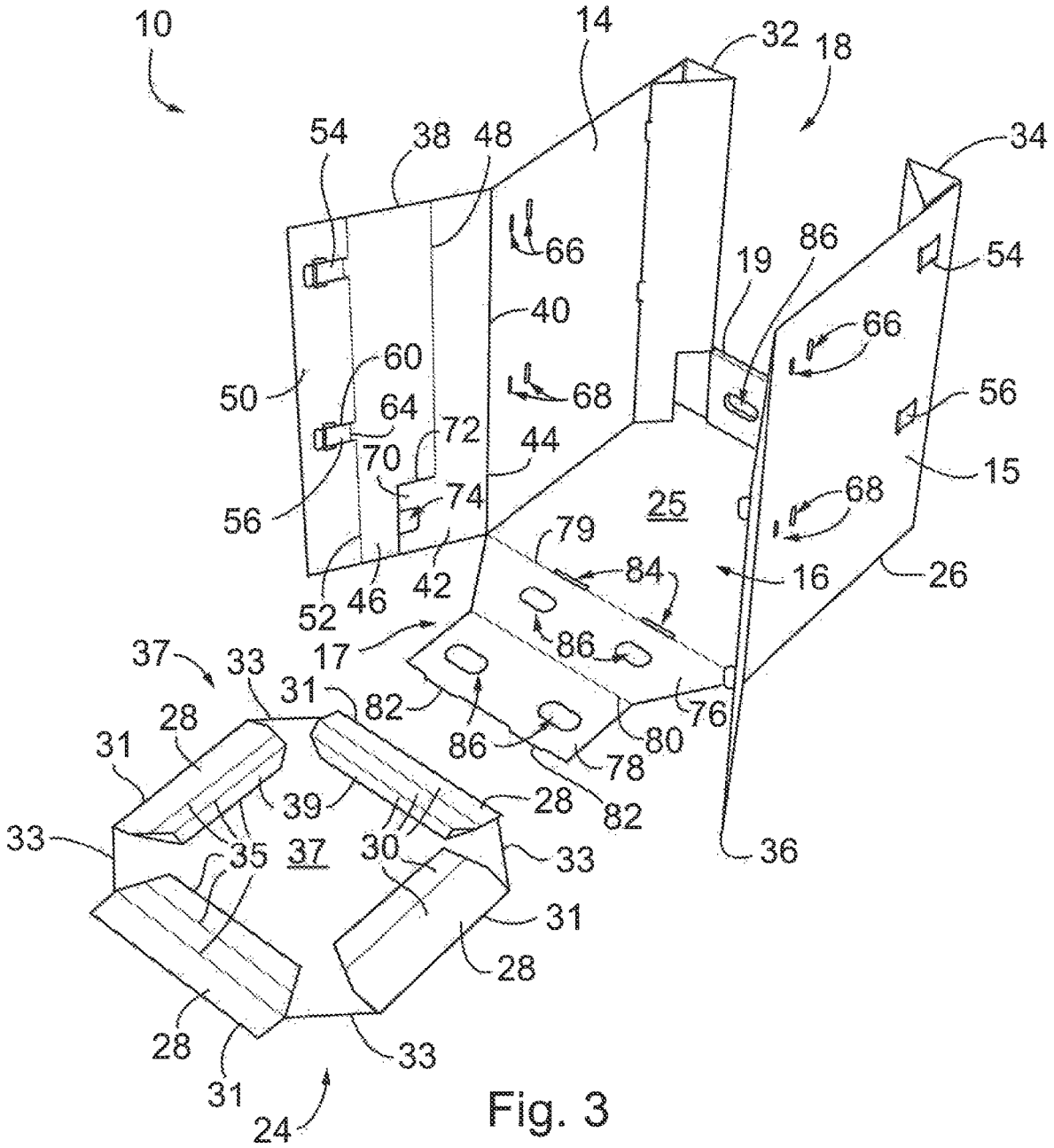
FIG. 3 is a perspective view of a partially folded package of FIG. 1 during the assembly of the package, according to an embodiment of the invention including a floor member.

Referring initially to FIG. 3, at a first assembly step 22 the package 10 is shown according to one representative embodiment of the invention, which includes a tray or floor member 24 and a receiver 26. As was previously described, the receiver 26 includes four walls; namely, opposing elongated first and second sides wall 14, 15, a front wall 17 and a rear wall 19, which extend outwardly from a bottom panel 25 that defines the base of the receiver 26. As shown in FIG. 3, side walls 14, 15 and rear wall 19 have been folded into an erected configuration such that they are generally perpendicular to bottom panel 25, which rests on a support surface such as a floor (not shown). Collectively, the bottom panel 25, side walls 14, 15 and rear wall 19 define the item receiving area 16 therein, while front wall 17 remains unfolded, i.e., in a flat configuration.

Still referring to FIG. 3, the floor member 24 may similarly be formed from a blank of shipping or packaging material. The floor member 24, in its partially-folded configuration shown in FIG. 3, is configured to be received within the item-receiving area 16 of the receiver 26 and has a size and shape defined by a perimeter 29 that is generally equivalent to that of the bottom panel 25 of the receiver 26. The floor member 24 includes a retainer structure 27 disposed about the perimeter 29 of the floor member 24. In one embodiment, as shown in FIG. 3, the retainer structure 27 is formed from a series of raised portions 28. The raised portions 28 are generally disposed about the sides 31 of the perimeter 29 of the floor member 24, which are configured to interface with the inner surfaces of walls 14, 15, 17, 19 of the receiver 26, when the floor member 24 is disposed within the item-receiving area 16. However, the raised portions 28 of the floor member 24 may be spaced apart from one another at the corners 33. That is to say that in one embodiment, the raised portions 28 that define the retainer structure 27 do not extend continuously about the perimeter 29 of the floor member 24, but rather are intermittently separated at their respective corners 33. In this folded configuration, the raised portions 28 are configured to engage with at least a portion of the item 12, such as the feet or casters of an office chair, which may be positioned in the corners 33 or interior to the raised portions 28 and secured between adjacent raised portions 28 and thereby limit and/or prevent undesirable shifting of the item 12 during shipping.

Each of the raised portions 28 of the floor member 24 is formed by way of folding a series of panels 30 about their adjacent fold or score lines 35. In a representative embodiment of the invention, each of the raised portions 28 are formed by the folding of three (3) panels 30, which are folded about their respective three (3) score lines 35 into a folded or erected configuration. In this folded configuration, the innermost panel 30 of each raised portion may be oriented nearly perpendicular to a bottom panel 37 of the floor member 24, thereby forming a retaining wall 39 that is configured to engage and secure the item 12 during shipment.

As shown in FIG. 3, at assembly step 22 the three raised portions 28 are folded into their erected configuration, which correspond to the location of the erected opposing side walls 14, 15 and rear wall 19 of the receiver 26. Similarly, the one remaining raised portion 28 that corresponds to the location of the unfolded front wall 17 of the receiver 26 remains in an unfolded position in step 22. Maintaining one raised portion 28 in an unfolded configuration will allow for the item 12 to be subsequently positioned on the floor member 24 via lateral movement of the item, without the need to vertically lift the item. Similarly, maintaining the front wall 17 in an unfolded configuration will also allow for the item 12 and floor member 24 to be subsequently positioned on the bottom panel 25 of the receiver 26 via lateral movement of the item 12, again without the need to vertically lift the item.

Still referring to FIG. 3, as was previously described, the receiver 26 is shown in a partially folded configuration with opposing elongated side walls 14, 15 and rear wall 19 in an erected configuration, while front wall 17 remains unfolded. In addition to the wall panels 14, 15, 17, 19 and base panel 25, the receiver 26 may also include reinforcing members located at its respective corners. That is to say, in the embodiment of the present invention shown in FIG. 3, where the receiver 24 includes four walls, the receiver 24 also includes four reinforcing members extending longitudinally at the corresponding four corners. Specifically, a first reinforcing member 32 is positioned at the corner formed between the first side wall 14 and the rear wall 19; a second reinforcing member 34 is positioned at the corner formed between the second side wall 15 and the rear wall 19; a third reinforcing member 36 is positioned at the corner formed between the second side wall 15 and the front wall 17; and a fourth reinforcing member 38 is positioned at the corner formed between the first side wall 14 and the front wall 17.

As seen in FIG. 3, the first and second reinforcing members 32, 34 are shown in their folded configuration between their respective wall segments of the receiver 26, while the third and fourth reinforcing members 36, 38 remain unfolded. At assembly step 22, the third and fourth reinforcing members 36, 38 remain unfolded, along with the front wall 17, to facilitate subsequent lateral movement of the item 12 and floor member 24 into the item-receiving area 16.

While the structure of the fourth reinforcing member 38 will now be described in further detail, it should be understood that the description applies to the assembly of each of the reinforcing members 32, 34, 36, which are formed of similar structure. In this regard, the fourth reinforcing member 38 is formed from a series of panels that extend from the lateral edge 40 of the side wall 14. As shown in FIG. 3, the fourth reinforcing member 38 is formed by the folding three (3) panels extending from the edge 40 of the first side panel 14, which fold inwardly to form the folded configuration of the fourth reinforcing member 38. Specifically, the first panel 42 is hingedly attached to the side panel 14 at a crease line 44 that defines the lateral edge 40 of the side wall 14. The opposing side of the first panel 42 is hingedly attached to the second panel 46 at a crease line 48. The opposing side of the second panel 46 is hingedly attached to the third panel 50 at a crease line 52. Together, the three panels 42, 46, 50 fold inwardly about their respective crease lines 44, 48, 52 to form a fourth reinforcing member 38 that has a generally triangular lateral cross section. In a folded configuration, which is shown in subsequent assembly steps, the first panel 42 of the fourth reinforcing member 38 will be folded approximately perpendicular to first side wall 14, about the crease line 44, such that the first panel 42 will lie generally in the plane of the front wall 17 of the receiver 26, and will define a side edge of the void 18 that is located above the front wall 17. The second panel 46 of the fourth reinforcing member 38 will be folded approximately 45 degrees relative to both the first side wall 14 and the front wall 17, as to define the hypotenuse of the generally triangular lateral cross section of the fourth reinforcing member 38. In this configuration, the inwardly facing surface of the second panel 46 may engage the item 12 received therein as to further limit shifting or movement during transportation. Finally, the third panel 50 of the fourth reinforcing member 38, in its folded configuration, will lie along the inner surface of the first side 14.

A first and a second tab 54, 56, respectively, may hingedly extend from the second panel 46 into the surface area of the third panel 50. The tabs 54, 56 may be defined by cut lines 58, 60, respectively, located about their edges that extend into the third panel 50, and by fold or crease lines 62, 64 that hingedly attach the first and second tabs 54, 56, respectively, to the second panel 46. When the fourth reinforcing member 38 is in its folded configuration, the first tab 54 is positioned adjacent the inner surface of the first side wall 14, and a corresponding series of slots or apertures 66 that extend through the first side wall 14 allow for the first tab 54 to extend therethrough, and secure the fourth reinforcing member 38 in its folded configuration. Similarly, when the fourth reinforcing member 38 is in its folded configuration, the second tab 56 is positioned adjacent the inner surface of the first side wall 14, below first tab 54, and a corresponding series of slots or apertures 68 that extend through the first side wall 14 allow for the second tab 56 to extend therethrough, and secure the fourth reinforcing member 38 in its folded configuration.

Additionally, as shown in FIG. 3, the bottom of the first panel 42 may include an elongated foot portion 70 which extends towards the second panel 46, and past crease line 48. The foot portion 70 may be defined by a cut line 72, which separates the foot portion 70 from the second panel 46. Additionally, a void or notch 74 may be disposed within the surface area of the foot portion 70 and adjacent the cut line 72. In a folded configuration of the fourth reinforcing member 38, the first panel 42 will lie in the plane of the front wall 17, and the foot portion 70 will extend medially along the bottom edge of front wall 17.

As shown in FIG. 3, where the front wall 17 is in a flat or unfolded configuration, the front wall 17 is formed of an outer panel 76 that is hingedly attached to the bottom panel 25 of the receiver 26 about a crease line 78. The opposing side of the outer panel 76 is hingedly attached to the inner panel 78 along a crease line 80. In this configuration, as will be described in subsequent steps, the front wall 17 is configured to be folded by first folding the third and fourth reinforcement members 36, 38, as was described above. Then, the outer panel 76 is rotated upward about crease line 79. Once the outer panel is engaging the foot portion 70 of both the third and fourth reinforcing members 36, 38, the inner panel 78 of the front wall 17 is rotated inward and downward about crease line 80, such that the foot portion 70 of both the third and fourth reinforcing members 36, 38 is sandwiched between the outer and inner panels 76, 78 of the front wall 17. The front wall 17 is maintained in this configuration by positioning two tabs 82 that extend outwardly from the exposed outer edge of the inner panel 78, through receiving slots 84 located along the crease line 79. Additionally, to facilitate movement of the package 10, handle voids 86 are located within both the inner and outer panels 78, 76. The notch 74 in the foot portion 70 of both the third and fourth reinforcing members 36, 38 is positioned in line with the respective handle voids 86 when folded, as will be shown in subsequent assembly steps. While the structure of the front wall 17, as it relates to the third and fourth reinforcing members 36, 38 is described above, it should be understood that the description equally applies to the assembly of the rear wall 19, as it relates to the corresponding first and second reinforcing members 32, 34, which are formed of similar structure and similarly assembled.

Figure 4:
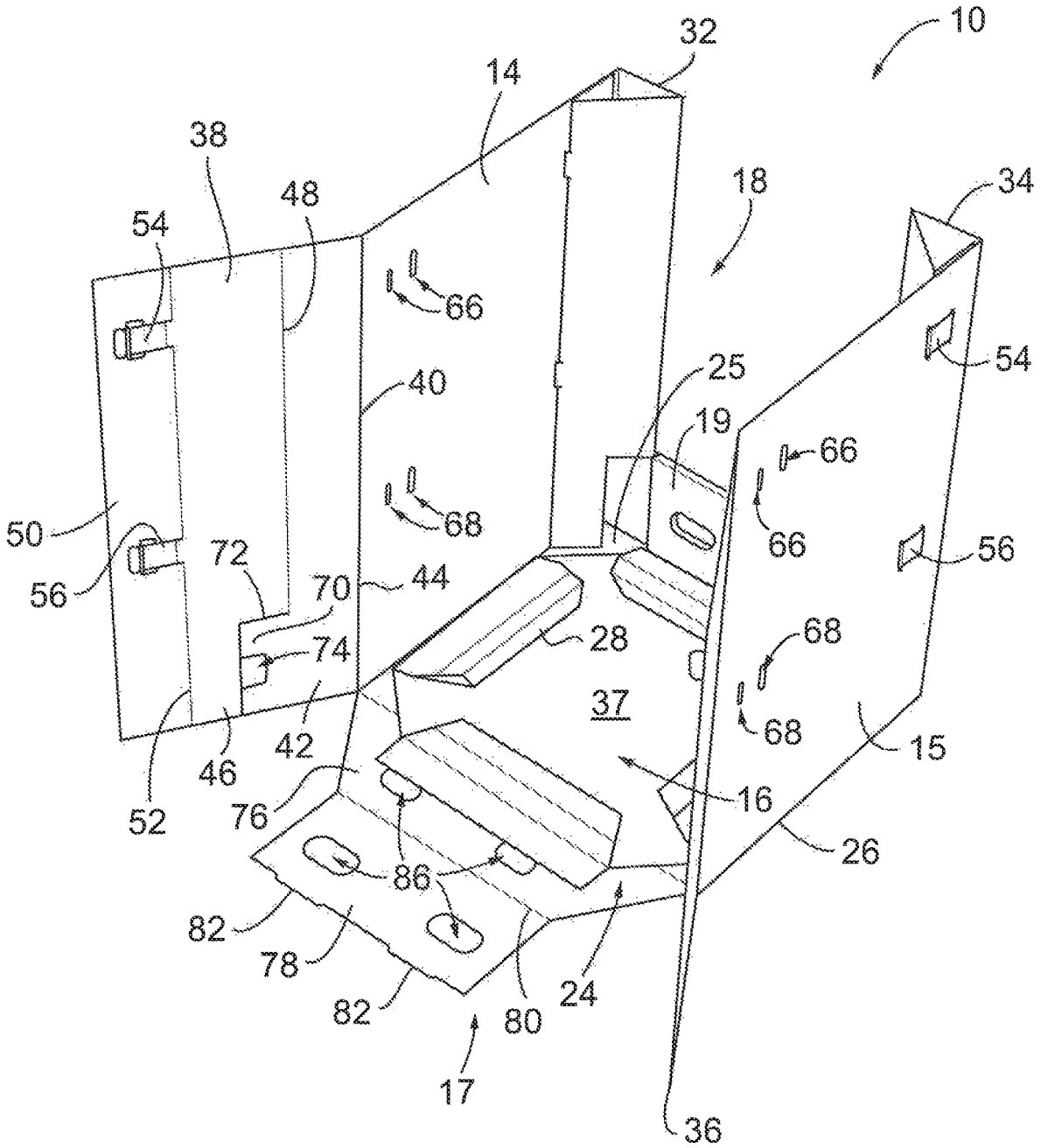
FIG. 4 is a perspective view of the partially folded package of FIG. 1 during a subsequent assembly step, in which the floor member has been inserted into the item-retaining area of the receiver.

Turning now to FIG. 4, at the second assembly step 88 the package 10 is shown with the floor member 24 placed within the item-receiving area 16 via lateral movement of the floor member 24 through the opening 18 defined between the opposing side walls 14, 15. In particular, the floor member 24 is disposed on top of the bottom panel 25 of the receiver 26. During step 88, the receiver 26 remains in the partially folded configuration described above with respect to FIG. 3, wherein the first side 14, second side 15, rear wall 19, first reinforcing member 32 and second reinforcing member 34 are folded into their erected configuration, but the front wall 17, third reinforcing member 36 and fourth reinforcing member 38 remain unfolded. Similarly, at least one of the raised portions 28 of the retainer structure 27 of the floor member 24 is maintained in the unfolded position 32 as well. While not shown in FIG. 4, the item 12, such as an office chair, may be placed on the floor member 38 before or after the floor member 24 is placed in the item-receiving area 16. However, it is contemplated that a user could place the item 12 into the item-receiving area 16 at any point during the formation of the package 10.

Figure 5:
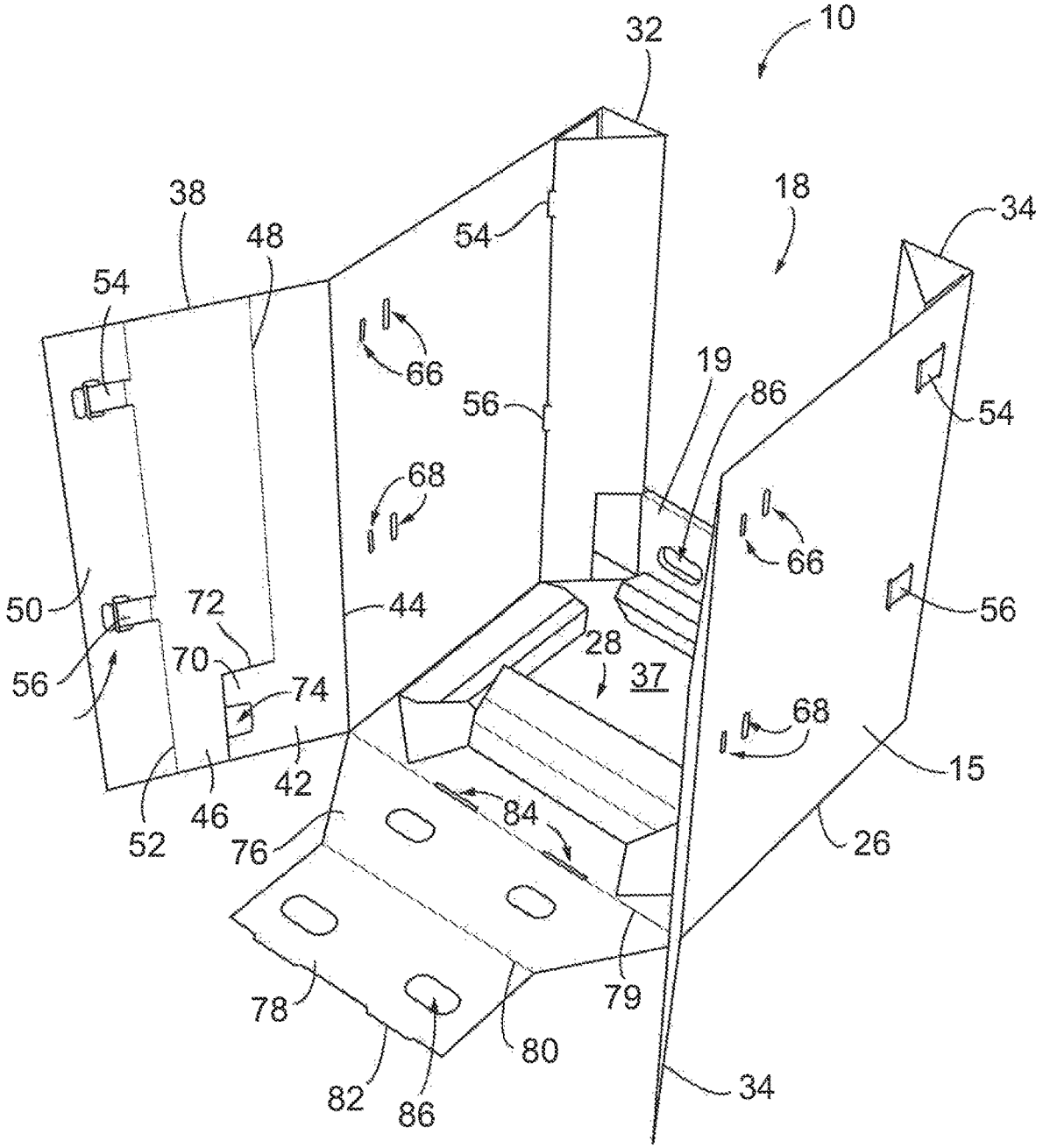
FIG. 5 is a perspective view of the partially folded package of FIG. 1 during a subsequent assembly step, in which a portion of the floor member has been folded upwards to form retainer structures.

Turning now to FIG. 5, at the third assembly step 90 the floor member 24 has been placed completely within the item receiving area 16 of the receiver 26, and the panels 30 of the remaining unfolded raised portion 28, which is positioned adjacent the front wall 17, are rotated about their respective fold lines 35. That is to say that the remaining unfolded raised portion 28 is transitioned to a partially folded configuration where the panels 30 remain elevated relative to the bottom panel 37 of the floor member 24.

Figure 6:
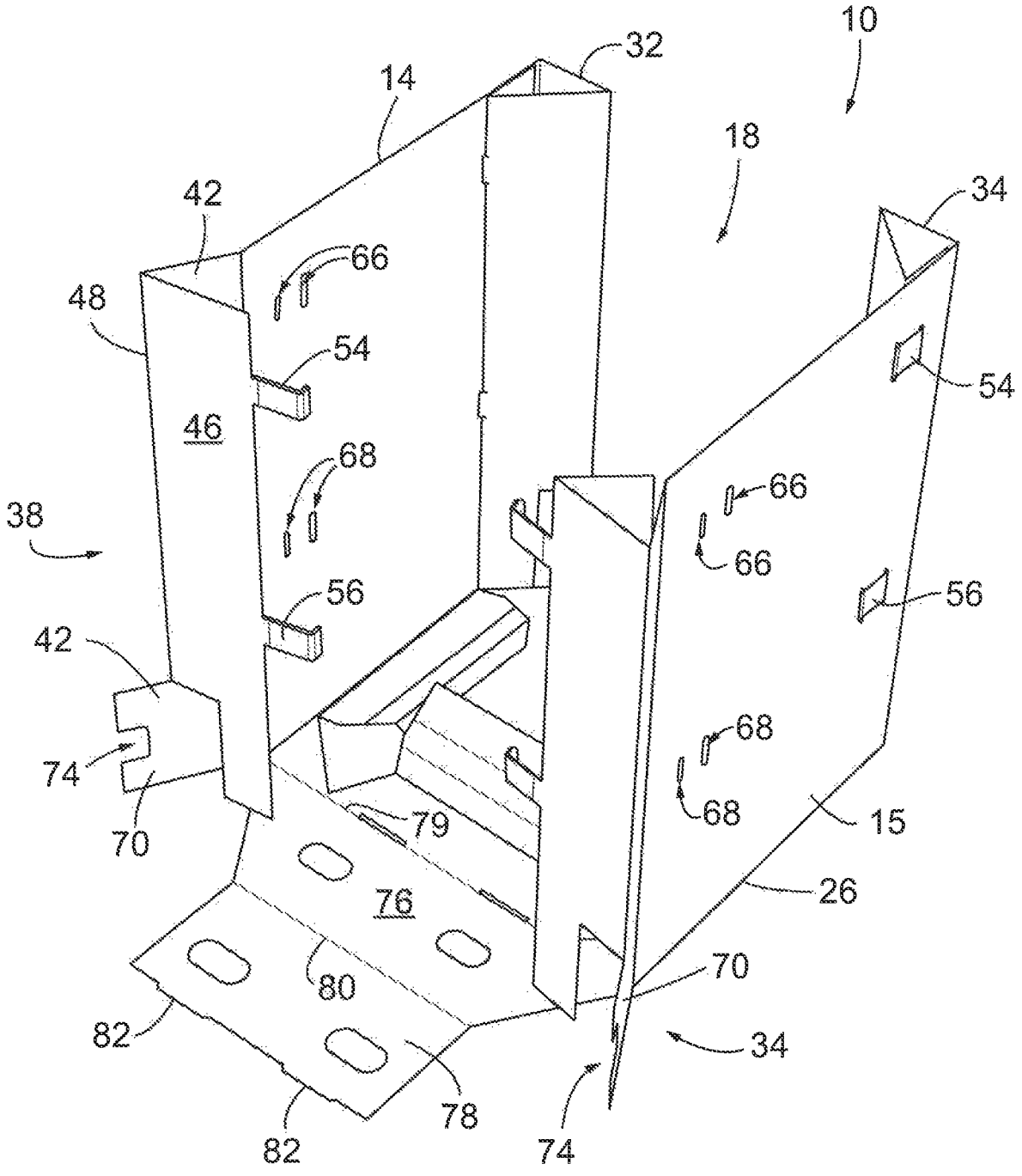
FIG. 6 is a perspective view of the partially folded package of FIG. 1 during a subsequent assembly step, in a which series of panels extending from opposing sidewalls of the receiver are partially folded inwards.

Turning now to FIG. 6, at the fourth assembly step 92, the third and fourth reinforcing members 36, 38 are folded inwards about their fold lines 44, 48, 52. In this step, tabs 54, 60 are removed from the surface area of the third panel 50 and the foot portion 70 is removed from the surface area of the second panel 46.

Figure 7:
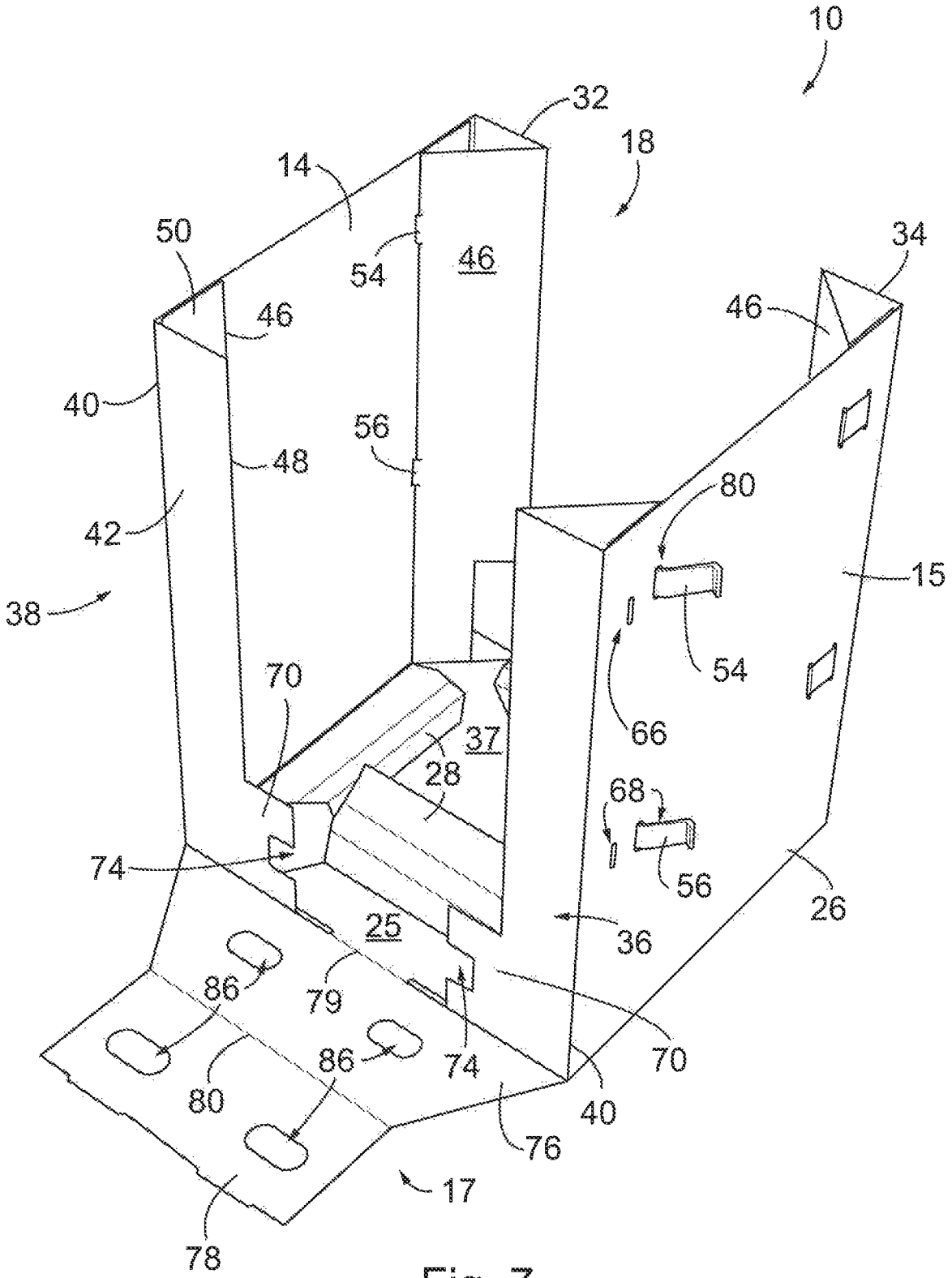
FIG. 7 is a perspective view of the partially folded package of FIG. 1 during a subsequent assembly step, in which the series of panels extending from opposing sidewalls of the receiver are fully folded inwards to form reinforcing members.

Turning now to FIG. 7, at the fifth assembly step 94, the panels 42, 46, 50 of each of the third and fourth reinforcing members 36, 38 are fully folded inwards about their fold lines 44, 48, 52, and configured into their final position. That is to say that the first panels 42 are approximately perpendicular to the side walls 14, 15 and disposed generally in the plane of the front wall 17 of the receiver 26, the second panels 46 are positioned approximately 45 degrees relative to both the respective side wall 14, 15 and the front wall 17, and the third panels 50 lie along the inner surface of their respective side wall 14, 15. In this step, tabs 54, 60 are extended through the first of their respective apertures 66, 68.

Figure 8:
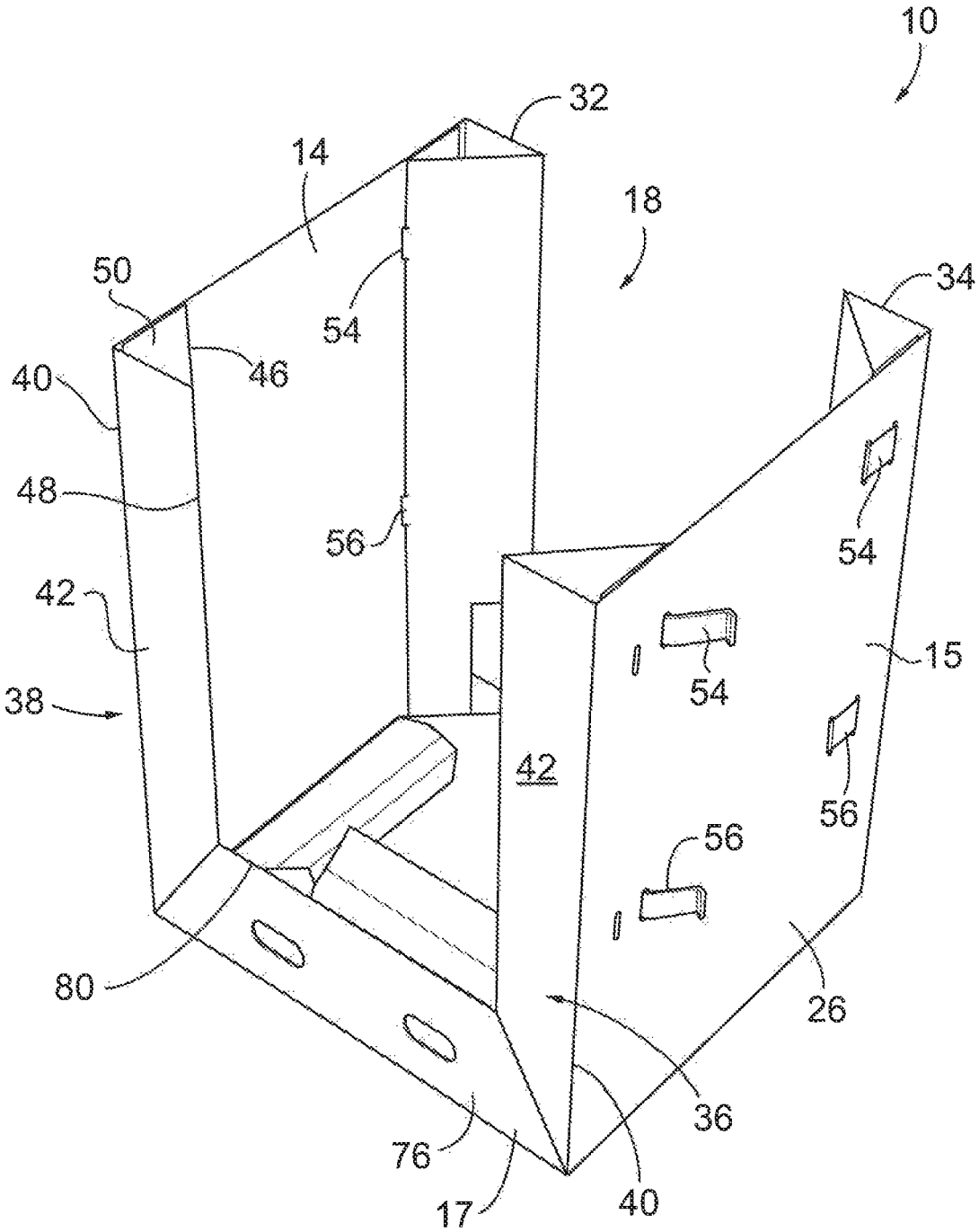
FIG. 8 is a perspective view of the partially folded package of FIG. 1 during a subsequent assembly step, in which a portion of the receiver that extends between the opposing sidewalls has been folded upwards to form a bottom retainer wall.

Turning now to FIG. 8, at the sixth assembly step 96, the inner and outer panels 78, 76 of the front wall 17 are folded about the foot portions 70 of the third and fourth reinforcing members 36, 38 in a manner generally described above. Accordingly, in this step, assembly of the front wall 17 is completed.

Figure 9:
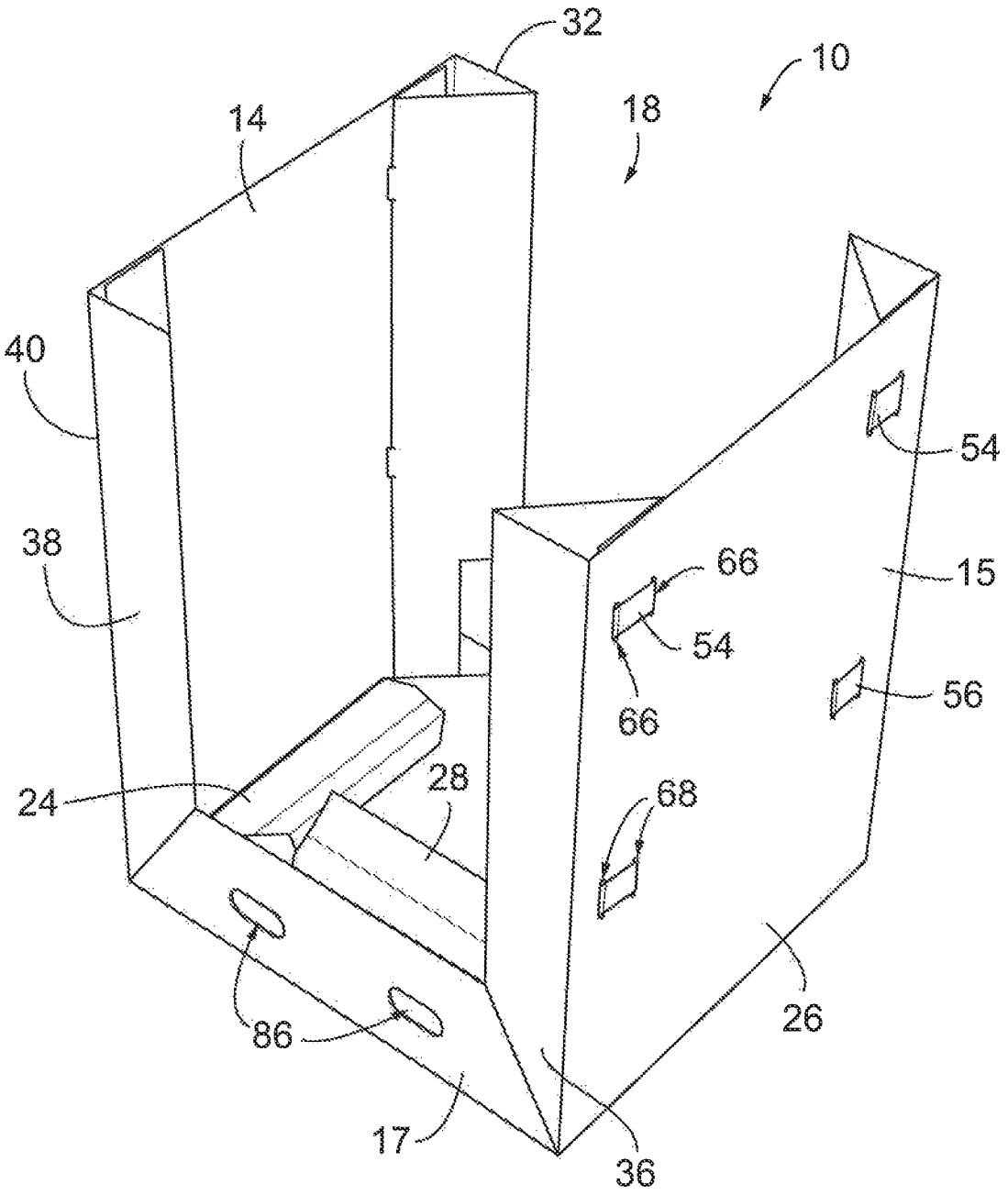
FIG. 9 is a perspective view of the partially folded package of FIG. 1 during a subsequent assembly step, in which tabs extending from the reinforcing members are secured to the opposing sidewalls.

Turning now to FIG. 9, at the seventh assembly step 98, tabs 54, 60 may be extended through the second of their respective apertures 66, 68 in the corresponding side wall 14, 15. In a representative embodiment of the invention, each tab 54, 60 may include a plurality of fold or crease lines, which allows the tabs 54, 60 to interlock with the respective apertures 66, 68. That is to say that the tabs may include segments which bend or fold between successive apertures to further secure the third and fourth reinforcing members 36, 38. While the representative embodiment of the invention uses tabs 54, 56 as described above to secure the reinforcing members in the complete folded configuration, it is contemplated that other locking devices known in the art may be used. Accordingly, in this step, assembly of the third and fourth reinforcing members 36, 38 is completed.

Figure 10:
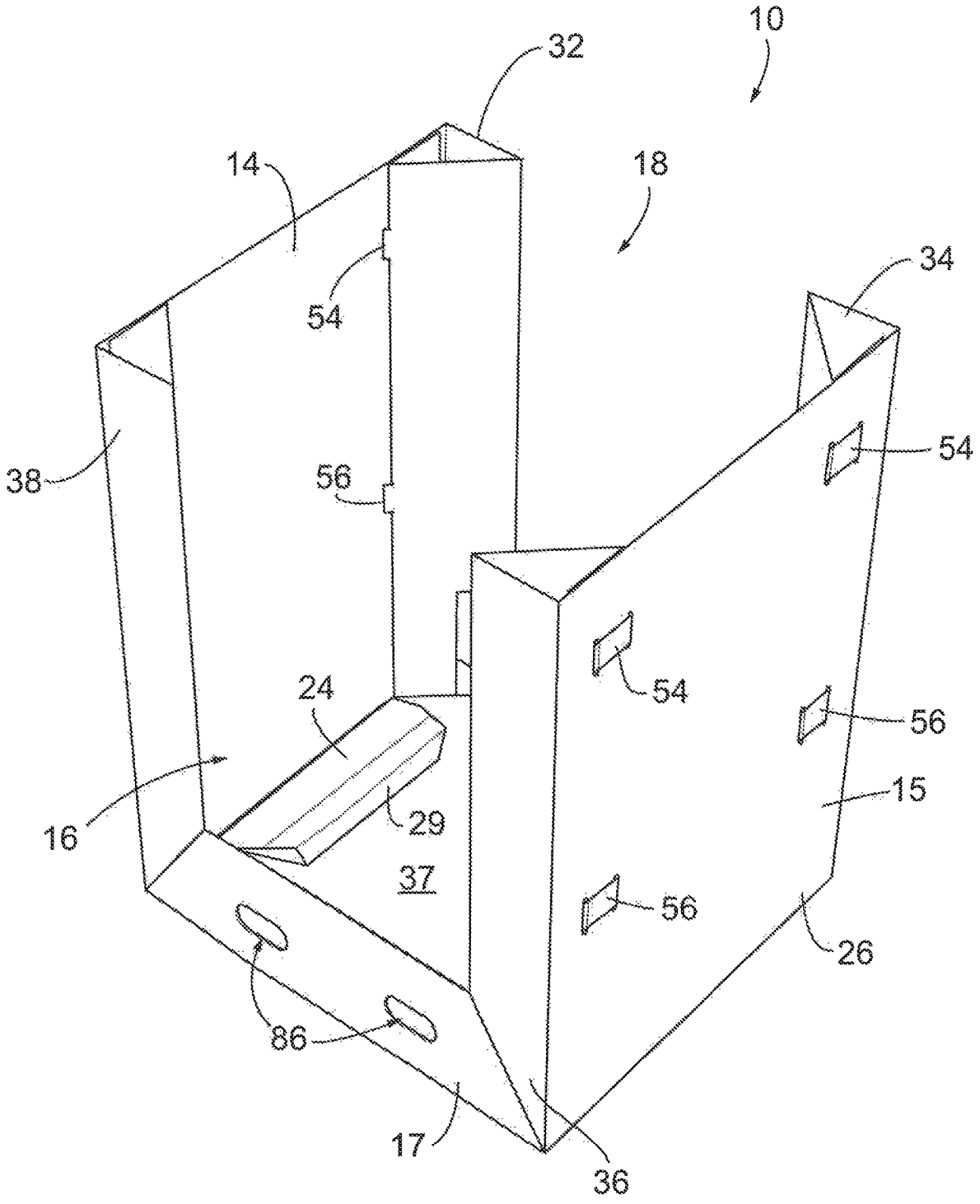
FIG. 10 is a perspective view of the fully folded receiver and floor member of the package of FIG. 1.
Figure 11:
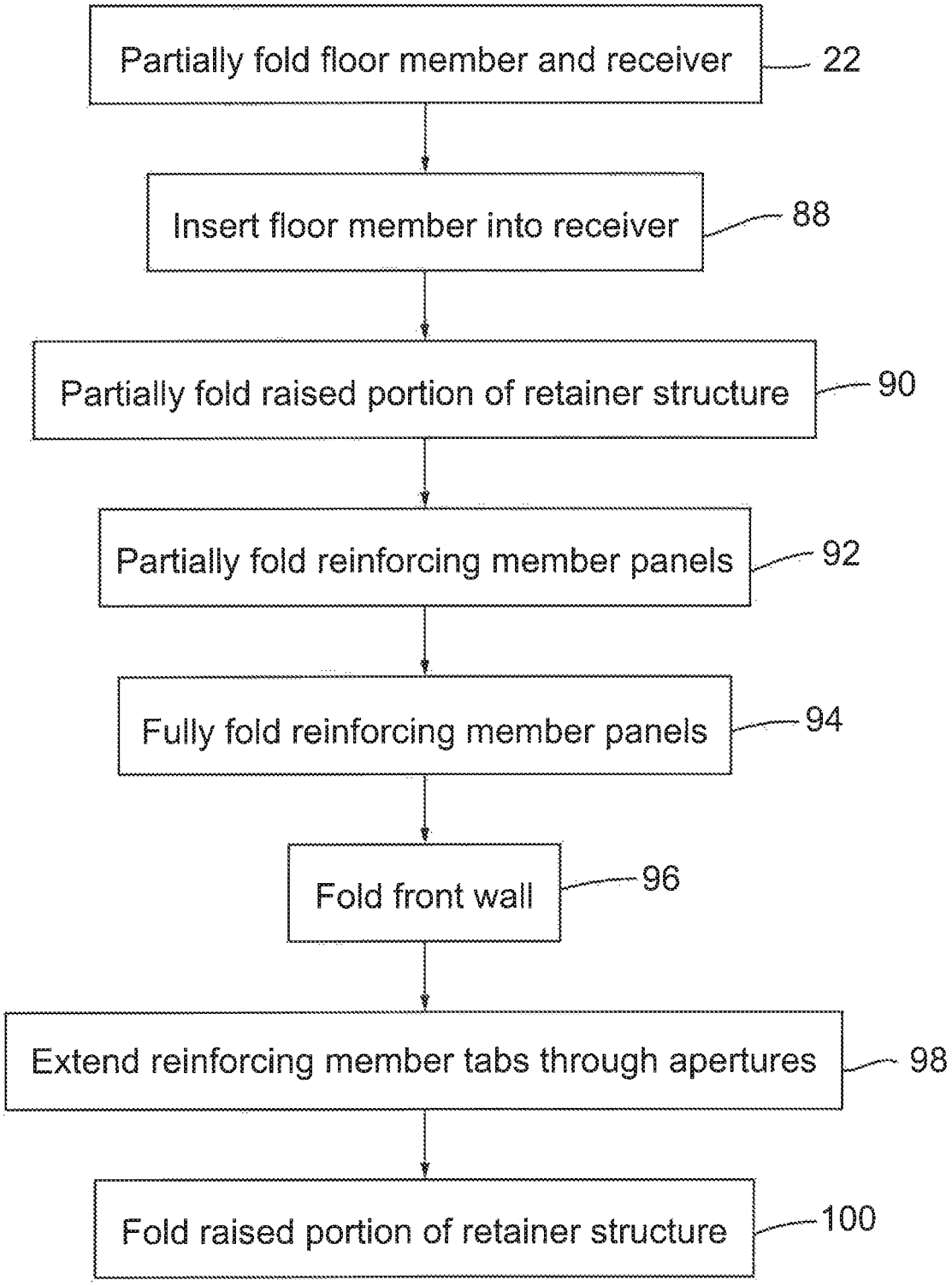
FIG. 11 is a flow chart of the steps of assembling a package of FIG. 1.

Turning now to FIG. 10, at the eighth and final assembly step 100, the panels 30 of the remaining partially folded raised portion 28, which is positioned adjacent the interior of the front wall 17, are fully folded about their respective fold lines 35 and transitioned to a fully folded configuration. That is to say that the floor member 24 and receiver 26 are fully assembled about item 12 (not shown). An optional cover 20 may now be placed over and/or around the walls 14, 15, 17, 19 of the package 10 in order to enclose the item-receiving space 16 and protect the item 12 during shipment. The cover 20 may be in the form of an open-bottomed carton that is moved vertically downwardly over the receiver 26 to enclose the receiver 26 and its contents. Alternatively, the receiver 26 may be wrapped with a flexible packaging material or its interior enclosed in any other satisfactory manner.

Figure 12:
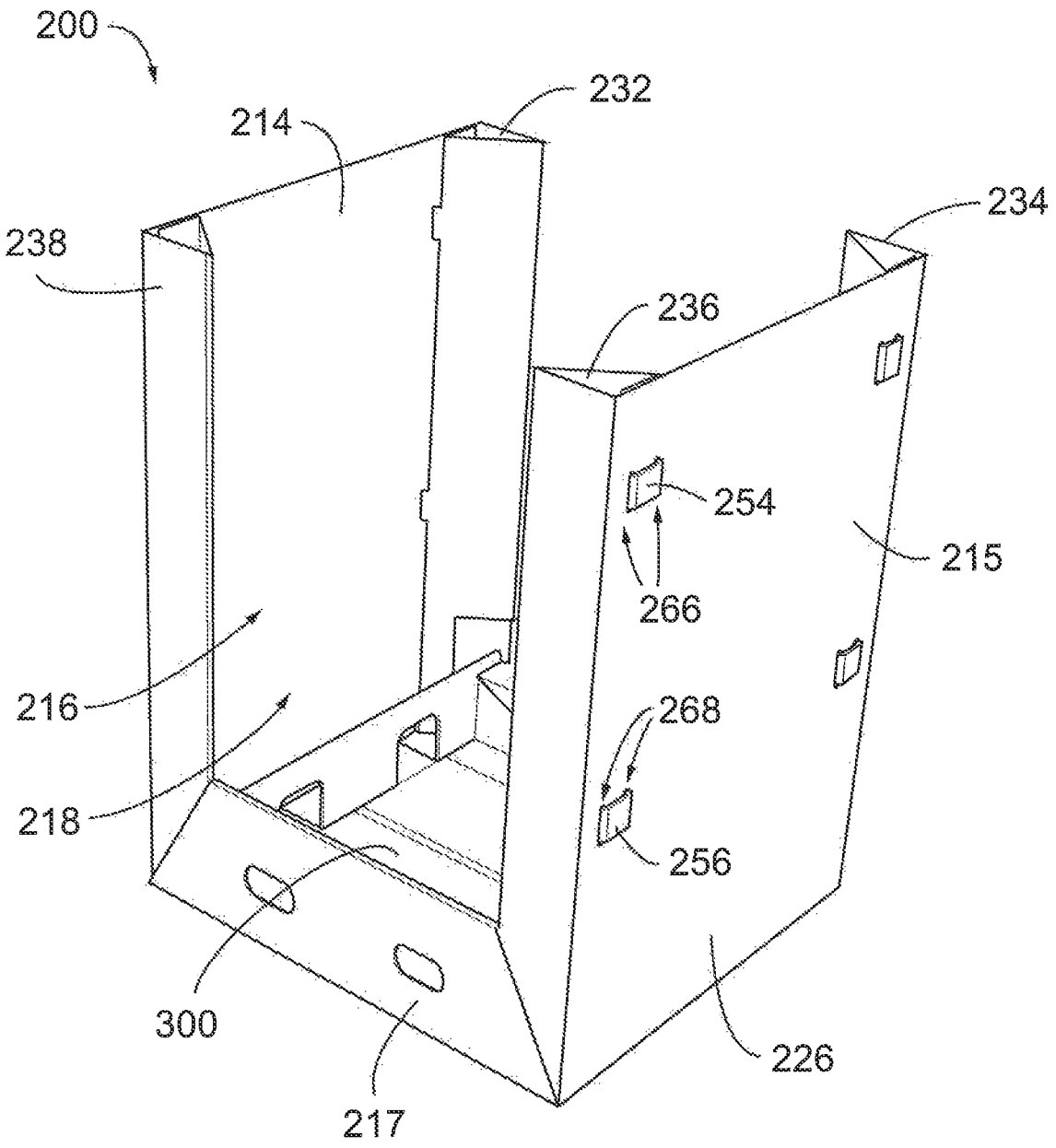
FIG. 12 is a perspective view of the fully folded receiver and an alternative floor member of a package according to one embodiment of the present invention.

Now referring to FIG. 12, a package 200 is shown according to another embodiment of the invention. It should be understood that package 200 is generally similar in structure to package 10 described in the prior embodiment. Moreover, the receiver 226 of package 200 is generally structurally consistent with the receiver 26 of package 10. Accordingly, as it relates to the receiver 226, like structures are identified by like reference numbers to which a value "200" has been added. An in-depth description of these similar structures is not duplicated below. However, in package 200, the floor member 300 does differ from the structure of the floor member 24 in package 10. Accordingly, the reference numbers associated with the floor member 300 differ from those structures identified in the preceding embodiment of the floor member 24. A discussion of the floor member 300, and its interaction with receiver 226 in package 200 follows.

Figure 13:
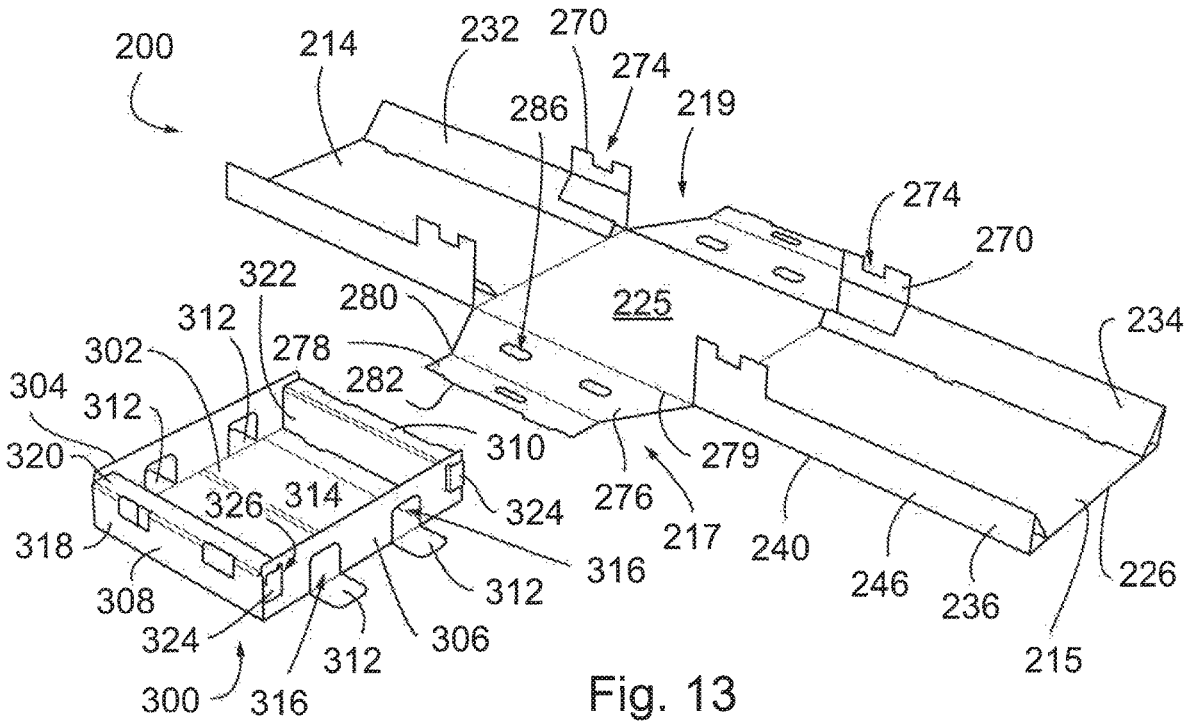
FIG. 13 is a perspective view of the partially folded package of FIG. 12 during the assembly of the package, showing a fully folded alternative floor member and a partially folded receiver.

Turning now to FIG. 13, a first formation step 222 of the furniture package 200, according to an embodiment of the invention is illustrated. The floor member 300 of package 200 includes a base 302, and extending therefrom: a first side wall 304; an opposing second side wall 306; a front wall 308 extending between the first and second side walls 304, 306; and, a rear wall 310 opposite the front wall 308. While the illustrated embodiment of floor member 300 shows four walls, it should be understood that the present invention is in no way so limited. The base 302 may further include a plurality of spacers 312 defined by cut lines 314 that extend into the surface area of the first and second side walls 304, 306, respectively, when the floor member 300 is in a flat configuration. When folded into an erected configuration, the first and second side walls 304, 306 will fold upwards, while the spacers 312 remain in the plane of the base 302 and extend outward from the first and second side walls 304, 306. Resultantly, the first and second side walls 304, 306 will also contain voids 316 which correspond to the size and shape of the spacers 312. The spacers 312 may have a length sufficient to engage the inner surface of the corresponding side wall 214, 215 of the receiver 226 as discussed below in order to maintain the floor member 300 in position within the package 200. Additionally, the front and rear walls 308, 310 may each be formed of a plurality of folded panels, including: an outer panel 318, an upper panel 320 and an inner panel 322. The panels 318, 320, 322 may be folded to form reinforced front and rear walls 308, 310 that provide additional structural strength to the floor member 300, and are secured to the adjacent side walls 304, 306 via interlocking tabs 324 and slots 326.

FIG. 13 further shows the receiver 226 in a partially folded configuration, where the reinforcing members 232, 234, 236, 238 have been folded into their final configuration, while the first side wall 212, second side wall 215, front wall 217 and rear wall 219 remain unfolded.

Figure 14:
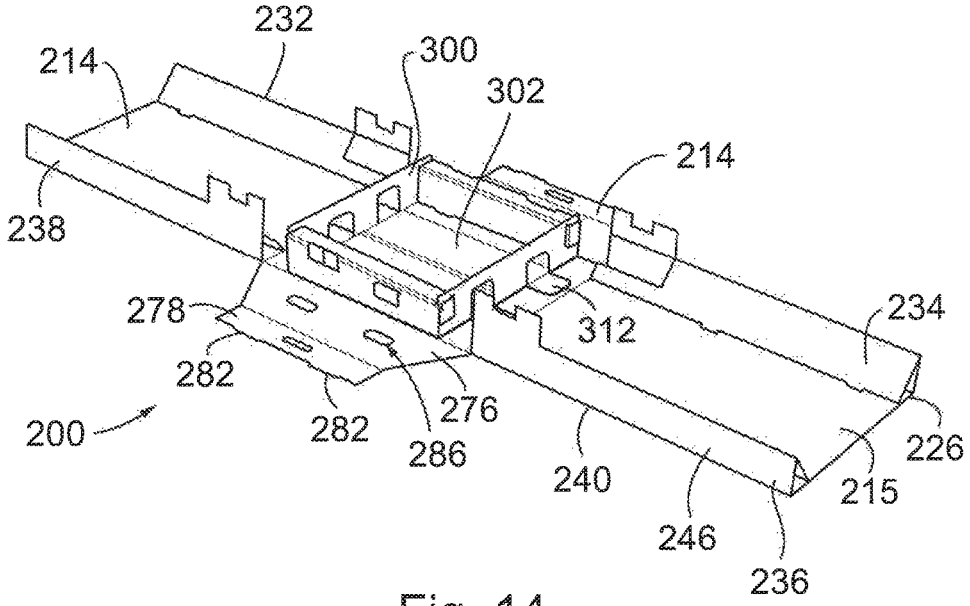
FIG. 14 is a perspective view of the partially folded alternative embodiment of the package of FIG. 12 during a subsequent assembly step, in which the fully folded alternative floor member has been placed onto a bottom panel of the partially folded receiver.

Turning now to FIG. 14, assembly step 288 is shown. In this step 288, the floor member 300 is placed within the item-receiving area 216. In particular, the floor member 300 is disposed on top of the bottom panel 225 of the receiver 226. The receiver 226 is still in the partially unfolded configuration initially shown in FIG. 12. In the representative embodiment of the invention, the floor member 300 is centrally located within the edges of the bottom panel 225 of the receiver 226.

Figure 15:
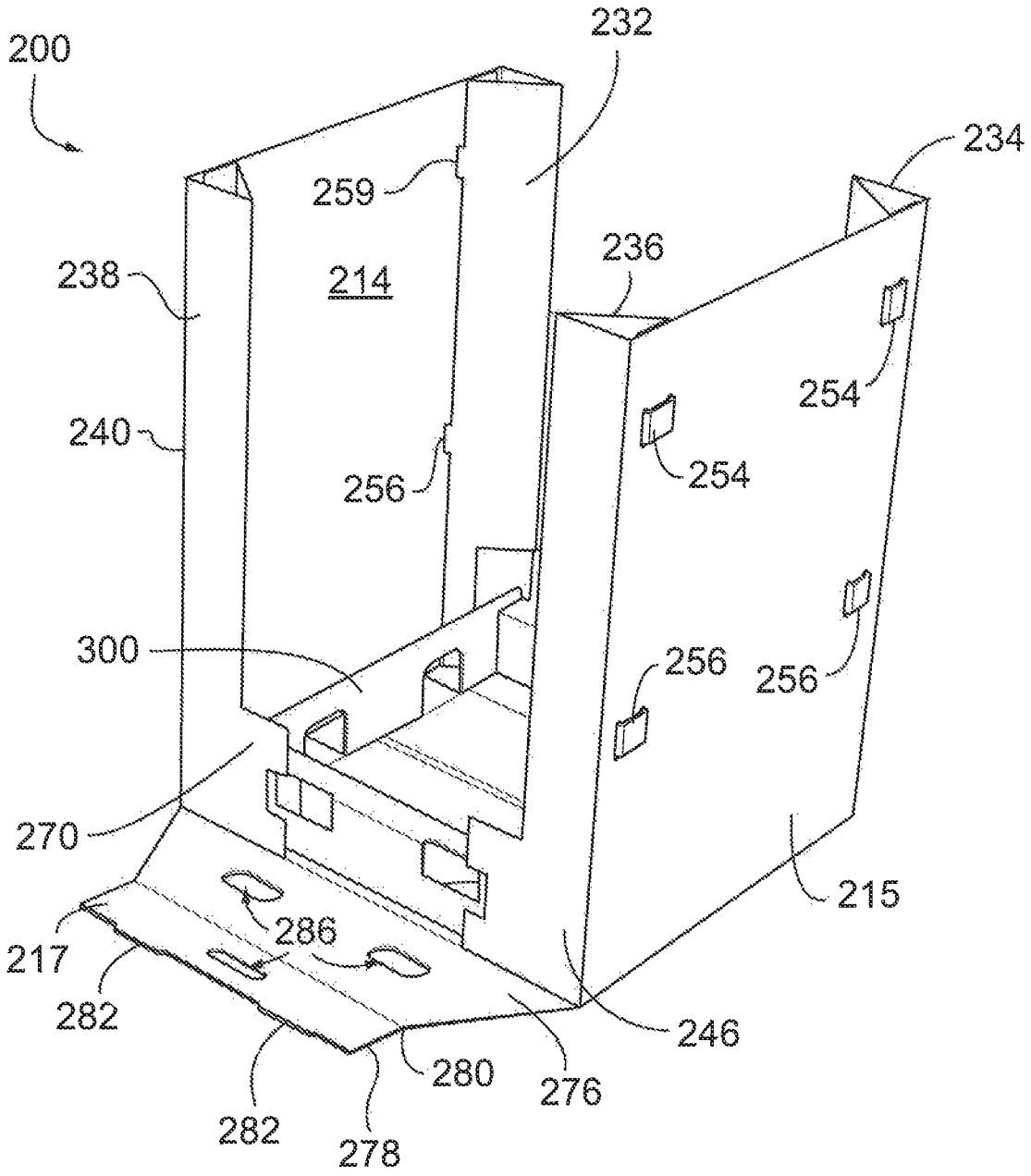
FIG. 15 is a perspective view of the partially folded alternative embodiment of the package of FIG. 12 during a subsequent assembly step, in which the opposing sidewalls have been raised and the reinforcing members have been formed.

Turning now to FIG. 15, assembly step 294 is shown. Once the floor member 300 has been placed within the item-receiving area 216, side walls 214, 215 are rotated upwards. In the representative embodiment of the invention, side walls 214, 215 are oriented perpendicular to the bottom panel 225 of the receiver 226. As shown in FIG. 14, each of the reinforcing members 232, 234, 236, 238 are fully folded inwards about their fold lines (not shown) and configured into their final position. That is to say that the first panels 242 are approximately perpendicular to the side walls 214, 215 and disposed generally in the plane of the front wall 217 of the receiver 226, the second panels 246 are approximately 45 degrees relative to the respective side wall 214, 215, and the third panels 250 lie along the inner surface of their respective side wall 214, 215. In this step, tabs 254, 260 are shown extended through their respective apertures 266, 268 and the foot portions 270 are in the plane of the front and rear walls 217, 219 respectively.

Figure 16:
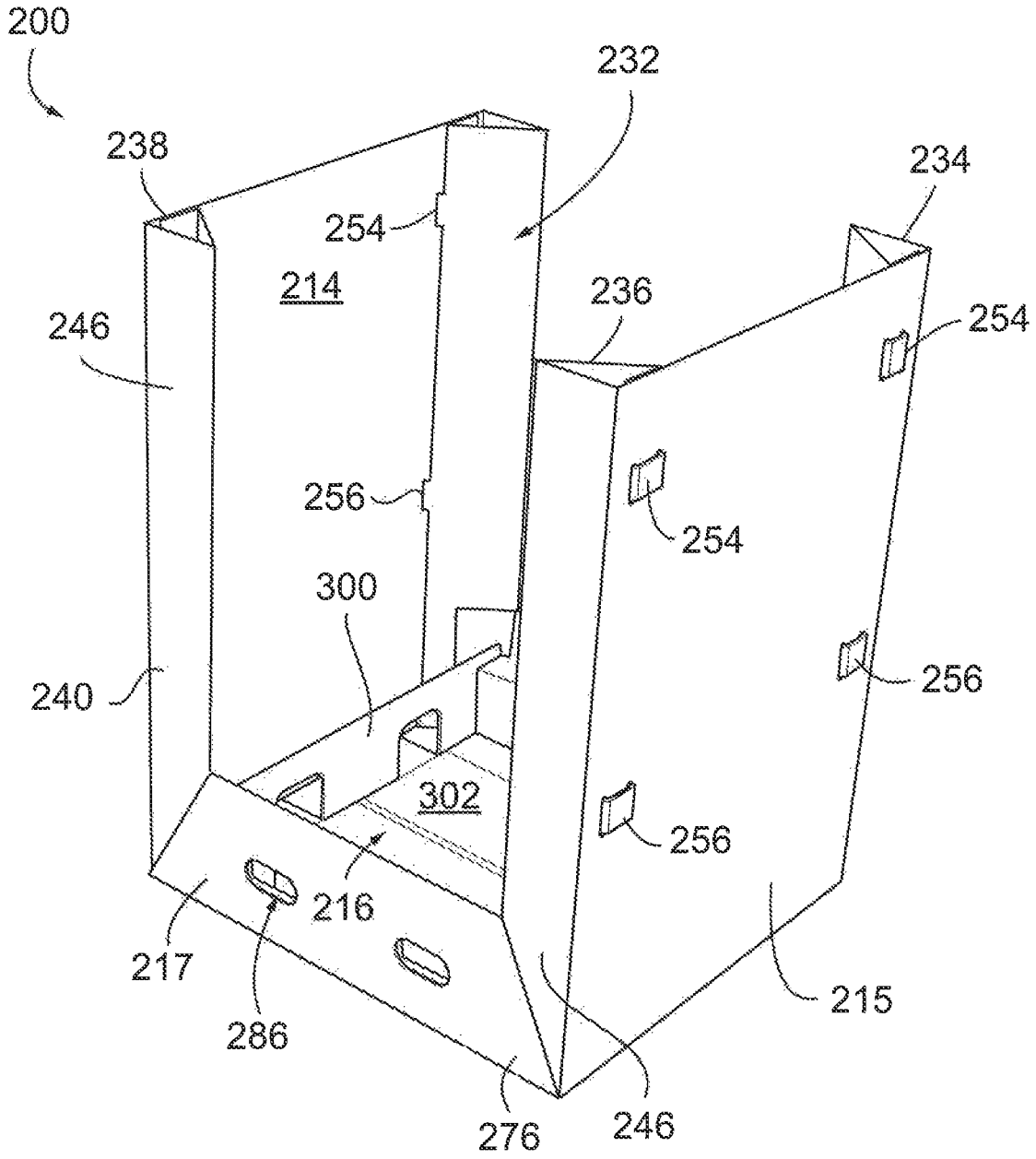
FIG. 16 is a perspective view of the fully folded receiver and floor member of the alternative embodiment of the package of FIG. 12.
Figure 17:
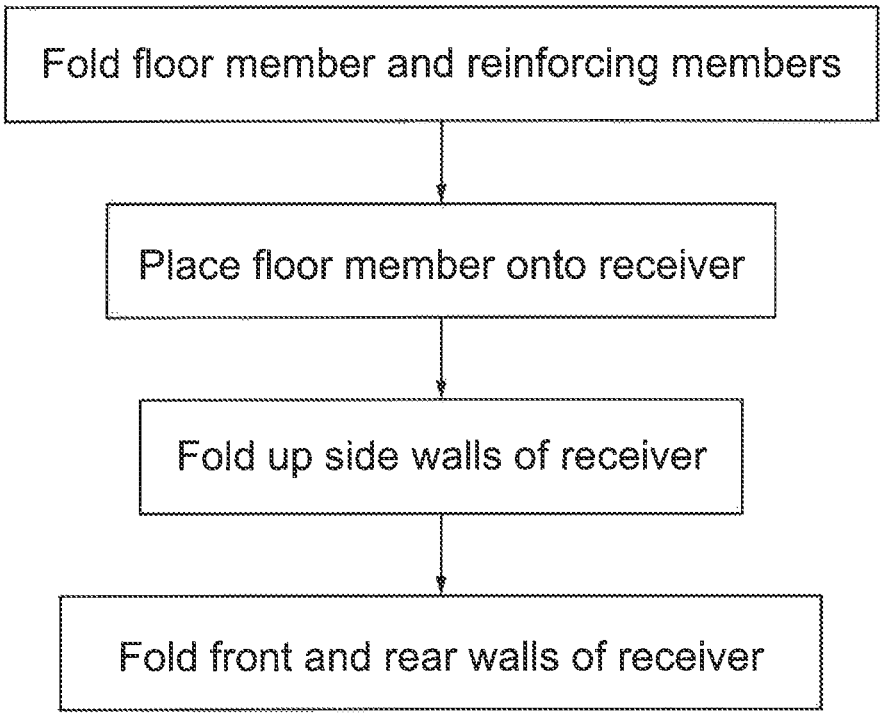
FIG. 17 is a flow chart of the steps of assembling a package of FIG. 12.

Turning now to FIG. 16, assembly step 298 is shown. In assembly step 298, the front and rear walls 217, 219, respectively, have been rotated into their folded configuration. The first and second side walls 214, 215 are maintained in the same position shown in FIG. 14. That is to say that the floor member 300 and receiver 226 are fully assembled about item 212 (not shown). An optional cover (not shown) may now be placed over and/or around the walls 214, 215, 217, 219 of the package 200 in order to enclose the item-receiving space 216 and protect the item 212 during shipment.

Although specific embodiments are illustrated and discussed above, it is understood that the size and shape of the packages 10, 200 may vary greatly to accommodate space requirements and the size and shape of item 12, 212 to be packaged in the item-receiving area 16, 216. Similarly, any number, location, variation or combination in the multiple styles of walls, panels, crease lines, floor members and receivers described herein is considered within the scope of the present invention.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

We claim:

1. A package for an item, comprising:

a receiver including a bottom panel and pair of spaced-apart sidewalls foldably connected to and extending upwardly from opposite sides defined by the bottom panel, wherein the bottom panel defines a series of corners and is adapted to be placed on a supporting surface such as a floor, and wherein the side walls are configured to be folded upwardly relative to the bottom panel and an item-receiving area is located above the bottom panel and between the sidewalls;

a reinforcing member extending upwardly from the bottom panel at each corner, wherein the reinforcing members are defined by the sidewalls, and wherein each reinforcing member is formed by a series of folded panels defined by an extension portion of one of the sidewalls;

an opening defined by the receiver and through which the item-receiving area is accessible, wherein the item is capable of being positioned within the item-receiving area via lateral movement of the item through the opening to position the item within the item-receiving area above the bottom panel; and a cover configured to be positioned about the receiver for enclosing the item-receiving area and maintaining the item therewithin.

2. The package of claim 1, further comprising locking structure associated with each reinforcing member and its associated sidewall for securing the folded panels in position relative to the side wall.

3. The package of claim 1, further comprising a floor member configured to be positioned on the bottom panel, and retainer structure associated with the floor member that interfaces with the item to prevent lateral movement of the item within the item-receiving area.

4. The package of claim 3, wherein the floor member comprises a floor panel and wherein the retainer structure comprises folded extensions of edge portions of the floor panel that are configured to abut the item.

5. The package of claim 1, further comprising a pair of bottom retainer walls that extend between the pair of sidewalls.

6. The package of claim 5, further comprising a floor member configured to be positioned on the bottom panel, and retainer structure associated with the floor member that interfaces with the items to prevent lateral movement of the item within the item-receiving area, and wherein the floor member comprises a floor panel and wherein the retainer structure is defined by folded extensions of the floor panel.

7. The package of claim 6, wherein locking structure is interposed between each reinforcing member and one of the bottom retainer walls.

8. The package of claim 7, wherein the bottom retainer wall comprises a pair of folded bottom wall panels, and wherein the locking structure comprises a locking tab on one of the panels of the side wall defining the reinforcing member, wherein the locking tab is received between and secured by the folded bottom wall panels.

9. A method of packaging an item, comprising the acts of:

providing a receiver including a bottom panel and pair of spaced-apart sidewalls foldably connected to and extending upwardly from opposite sides defined by the bottom panel, wherein the bottom panel defines a series of corners and is adapted to be placed on a supporting surface such as a floor, and wherein the side walls are folded upwardly relative to the bottom panel and an item-receiving area is located above the bottom panel and between the sidewalls, and wherein an opening is defined by the receiver above the bottom panel and between the sidewalls through which the item-receiving area is accessible, and wherein the receiver further includes a reinforcing member extending upwardly from the bottom panel at each corner, wherein the reinforcing members are defined by the sidewalls, and wherein each reinforcing member is formed by a series of folded panels defined by an extension portion of one of the sidewalls;

moving the item laterally through the opening into the item-receiving area to position the item within the item-receiving area above the bottom panel; and enclosing the receiver with a cover that is positioned about the receiver for enclosing the item-receiving area defined by the receiver and maintaining the item within the item-receiving area.

10. The method of claim 9, further comprising engaging each reinforcing member with its associated sidewall for securing the folded panels in position relative to the side wall.

11. The method of claim 9, further comprising the act of positioning a floor member on the bottom panel, and providing retainer structure on the floor member that interfaces with the item to prevent lateral movement of the item within the item-receiving area.

12. The method of claim 11, wherein the floor member comprises a floor panel and wherein the act of providing retainer structure is carried out by folding extensions of edge portions of the floor panel about the item.

13. The method of claim 9, further comprising the act of providing a pair of bottom retainer walls that extend between the pair of sidewalls.

14. The method of claim 13, further comprising the act of positioning a floor member on the bottom panel, wherein the floor member comprises a floor panel, and wherein the act of providing retainer structure is carried out by folding extensions of the floor panel.

15. The method of claim 14, further comprising the act of engaging locking structure between each reinforcing member and one of the bottom retainer walls.

16. The method of claim 15, wherein the bottom retainer wall comprises a pair of folded bottom wall panels, and wherein the locking structure comprises a locking tab on one of the panels of the side wall defining the reinforcing member, and positioning the locking tab between the folded bottom wall panels.

17. A package for an item, comprising:

a receiver including a bottom panel and pair of spaced-apart sidewalls extending upwardly from opposite sides defined by the bottom panel, wherein the bottom panel defines a series of corners and is adapted to be placed on a supporting surface such as a floor, and wherein an item-receiving area is located above the bottom panel and between the sidewalls;

a reinforcing member extending upwardly from the bottom panel at each corner;

an opening defined by the receiver and through which the item-receiving area is accessible, wherein the item is capable of being positioned within the item-receiving area via lateral movement of the item through the opening to position the item within the item-receiving area above the bottom panel;

a floor member configured to be positioned on the bottom panel, and retainer structure associated with the floor member that interfaces with the item to prevent lateral movement of the item within the item-receiving area, wherein the floor member comprises a floor panel and wherein the retainer structure comprises folded extensions of edge portions of the floor panel that are configured to abut the item; and a cover configured to be positioned about the receiver for enclosing the item-receiving area and maintaining the item therewithin.

18. A package for an item, comprising:

a receiver including a bottom panel and pair of spaced-apart sidewalls extending upwardly from opposite sides defined by the bottom panel, and a pair of bottom retainer walls that extend between the pair of sidewalls, wherein the bottom panel defines a series of corners and is adapted to be placed on a supporting surface such as a floor, and wherein an item-receiving area is located above the bottom panel and between the sidewalls;

a reinforcing member extending upwardly from the bottom panel at each corner;

an opening defined by the receiver and through which the item-receiving area is accessible, wherein the item is capable of being positioned within the item-receiving area via lateral movement of the item through the opening to position the item within the item-receiving area above the bottom panel; and a cover configured to be positioned about the receiver for enclosing the item-receiving area and maintaining the item therewithin.

19. The package of claim 18, further comprising a floor member configured to be positioned on the bottom panel, and retainer structure associated with the floor member that interfaces with the item to prevent lateral movement of the item within the item-receiving area, and wherein the floor member comprises a floor panel and wherein the retainer structure is defined by folded extensions of the floor panel.

20. The package of claim 19, wherein each reinforcing member is formed by a series of folded panels defined by an extension portion of one of the sidewalls, and wherein locking structure is interposed between each reinforcing member and one of the retainer walls.

21. The package of claim 20, wherein the bottom retainer wall comprises a pair of folded bottom wall panels, and wherein the locking structure comprises a locking tab on one of the panels of the side wall defining the reinforcing member, wherein the locking tab is received between and secured by the folded bottom wall panels.

22. A method of packaging an item, comprising the acts of:

providing a receiver including a bottom panel and pair of spaced-apart sidewalls extending upwardly from opposite sides defined by the bottom panel, wherein the bottom panel defines a series of corners and is adapted to be placed on a supporting surface such as a floor, and wherein an item-receiving area is located above the bottom panel and between the sidewalls, and wherein an opening is defined by the receiver through which the item-receiving area is accessible;

providing a reinforcing member extending upwardly from the bottom panel at each corner;

positioning a floor panel on the bottom panel, and providing retainer structure on the floor panel;

moving the item laterally through the opening into the item-receiving area to position the item within the item-receiving area above the bottom panel, wherein the retainer structure on the floor member interfaces with the item to prevent lateral movement of the item within the item-receiving area, and wherein the act of providing retainer structure is carried out by folding extensions of edge portions of the floor panel about the item; and enclosing the receiver to maintaining the item within the item-receiving area defined by the receiver.

23. A method of packaging an item, comprising the acts of:

providing a receiver including a bottom panel and pair of spaced-apart sidewalls extending upwardly from opposite sides defined by the bottom panel, wherein the bottom panel defines a series of corners and is adapted to be placed on a supporting surface such as a floor, and wherein an item-receiving area is located above the bottom panel and between the sidewalls, and wherein an opening is defined by the receiver through which the item-receiving area is accessible;

providing a reinforcing member extending upwardly from the bottom panel at each corner;

providing a pair of bottom retainer walls that extend between the pair of sidewalls;

moving the item laterally through the opening into the item-receiving area to position the item within the item-receiving area above the bottom panel; and enclosing the receiver to maintaining the item within the item-receiving area defined by the receiver.

24. The method of claim 23, further comprising the act of positioning a floor member on the bottom panel, and providing retainer structure on the floor member that interfaces with the item to prevent lateral movement of the item within the item-receiving area, wherein the floor member comprises a floor panel and wherein the act of providing retainer structure is carried out by folding extensions of the floor panel.

25. The method of claim 24, wherein each reinforcing member is formed by a series of folded panels defined by an extension portion of one of the sidewalls, and further comprising the act of engaging locking structure between each reinforcing member and one of the retainer walls.

26. The method of claim 25, wherein the bottom retainer wall comprises a pair of folded bottom wall panels, and wherein the locking structure comprises a locking tab on one of the panels of the side wall defining the reinforcing member, and positioning the locking tab between the folded bottom wall panels.

* * * * *